United States Patent [19]

Sogawa

[11] Patent Number: 4,770,147

[45] Date of Patent: Sep. 13, 1988

[54] AIR-FUEL RATIO CONTROL SYSTEM FOR AN ENGINE

[75] Inventor: Yoshiyuki Sogawa, Hachiohji, Japan

[73] Assignee: Fuji Jukogyo Kabushiki Kaisha, Tokyo, Japan

[21] Appl. No.: 39,616

[22] Filed: Apr. 16, 1987

[30] Foreign Application Priority Data

Apr. 25, 1986 [JP] Japan ..... 61-096522
Apr. 25, 1986 [JP] Japan ..... 61-096523

[51] Int. Cl.[4] ..... F02M 7/00
[52] U.S. Cl. ..... 123/489; 123/440
[58] Field of Search ..... 123/489, 480, 440, 486, 123/478

[56] References Cited

U.S. PATENT DOCUMENTS 4,505,246 3/1985 Nakajima et al. ..... 123/489
4,566,419 1/1986 Ninomiya et al. ..... 123/489
4,566,420 1/1986 Sakamoto et al. ..... 123/489
4,622,125 11/1986 Oyama et al. ..... 123/489

*Primary Examiner*—Raymond A. Nelli
*Attorney, Agent, or Firm*—Martin A. Farber

[57] ABSTRACT

An air-fuel ratio feedback control system is provided with a section for producing a desired air-fuel ratio dependent on engine operating conditions and with an inherent time delay calculator for producing a time delay signal. The change of the desired air-fuel ratio dependent on the change of the engine operating conditions is delayed for a period dependent on the time delay signal.

9 Claims, 6 Drawing Sheets

AIR-FUEL RATIO CONTROL SYSTEM FOR AN ENGINE

BACKGROUND OF THE INVENTION

The present invention relates to an air-fuel ratio control system for an engine of a motor vehicle, and more particularly for an engine supplied with lean mixture.

A lean mixture engine is disclosed, for example, in Japanese Patent Laid Open 58-48749.

The lean mixture engine operates on lean mixture at light and middle load and on stoichiometry mixture at heavy load. A feedback air-fuel ratio control is provided for supplying the air-fuel mixture at large air-fuel ratio (lean mixture) or stoichiometric air-fuel ratio in accordance with engine operating conditions.

The feedback control system is provided with a lean mixture sensor for sensing the oxygen concentration of the exhaust gas of the engine, the output voltage of which is proportional to the oxygen concentration. In a fuel injection system for the lean mixture engine, a plurality of desired air-fuel ratios are stored in a look-up table in accordance with engine operating conditions. A feedback signal from the lean mixture sensor is compared with the desired air-fuel ratio AFd to produce an error signal. A feedback coefficient $K_{FB}$ for fuel injection is calculated based on the error signal. On the other hand, an air-fuel ratio coefficient $K_{AF}$ based on engine operating conditions and a miscellaneous coefficient COEF including a plurality of coefficients based on various operating conditions such as coolant temperature, intake air temperature and other are calculated based on the desired air-fuel ratio AFd.

Fuel injections time TI of injected fuel is calculated as follows.

$$TI = K \times K_{AF} \times K_{FB} \times Q/N \times COEF \quad (1)$$

where

K is a correcting coefficient, where

Q is intake air flow rate, and

N is engine speed.

By injecting fuel during the calculated time, the air-fuel ratio is controlled to the desired air-fuel ratio.

Referring to FIG. 6, when the desired air-fuel ratio AFd varies from one value to another value dependent on the changing of engine operating condition at a time $t_1$, the control of the air-fuel ratio is delayed in spite of the immediate change of the feedback coefficient $K_{FB}$, because of inherent time delay. As a result, the control system oscillates, so that the actual air fuel ratio AFa oscillates as shown in FIG. 6.

In order to prevent this hunting, for example, Japanese Patent Laid Open 58-59330 discloses a system in which, when a desired air-fuel ratio changes, a correcting coefficient is increased until the output of a lean mixture sensor exceeds a set value.

SUMMARY OF THE INVENTION

The object of the present invention is to provide a system which may control the air-fuel ratio without oscillating the system.

According to the invention, there is provided an air-fuel ratio control system for an engine, comprising sensing means for sensing engine operating conditions and for producing operating condition signals, a sensor sensing oxygen concentration of exhaust gas of the engine and producing a feedback signal dependent on the concentration, first means responsive to the operating condition signals for producing a desired air-fuel ratio signal, second means responsive to the operating condition signals for producing a time delay signal, third means responsive to the time delay signal for producing a corrected desired air-fuel ratio signal, the change of the corrected desired air-fuel ratio signal being dependent on changes of operating condition signals and being delayed for a time dependent on the time delay signal, fourth means responsive to the error signal for deciding amount of fuel supplied to the engine.

In an aspect of the invention, the time delay signal includes a first-order lag and a transport time delay.

The other objects and features of this invention will become understood from the following description with reference to the accompanying drawings.

DETAILED DESCRIPTION OF THE PREFERRED EMBODIMENTS

Figure 1:
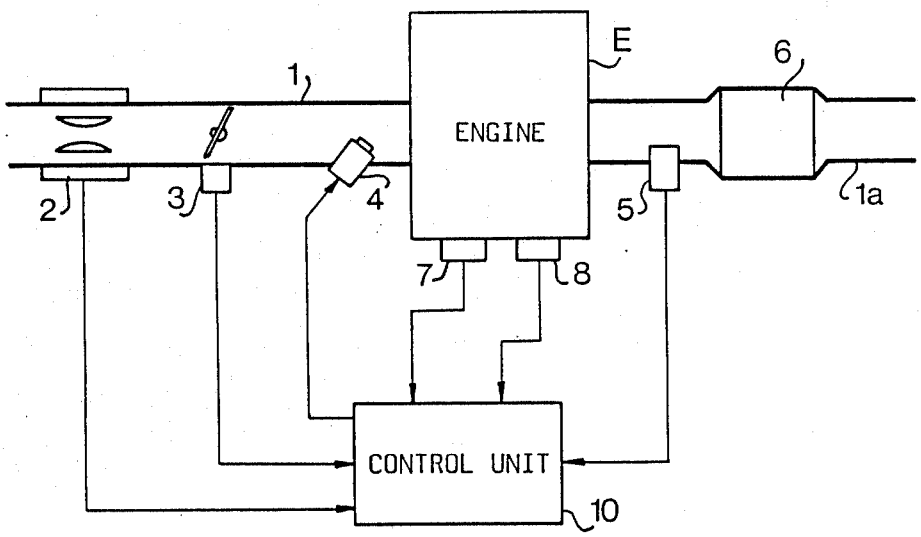
FIG. 1 is a schematic diagram showing a control system of the present invention.
Figure 2:
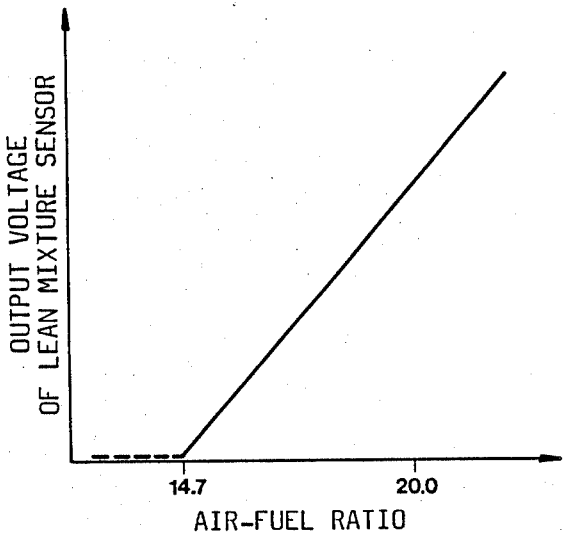
FIG. 2 is a graph showing an output characteristic of a lean mixture sensor.

Referring to FIG. 1, an air flow meter 2 for producing an air flow signal Q, throttle position sensor 3 and fuel injector 4 are mounted on an intake pipe 1 of an engine E. In an exhaust pipe 1*a*, a lean mixture sensor 5 and a catalytic converter 6 are provided. Mounted on the engine E are a coolant temperature sensor 7 and a crank angle sensor 8 which produces an engine speed signal N. Output signals of those sensors are applied to a control unit 10. As shown in FIG. 2, the output voltage of the lean mixture sensor 5 is proportional to the air-fuel ratio of lean mixture.

Figure 3:
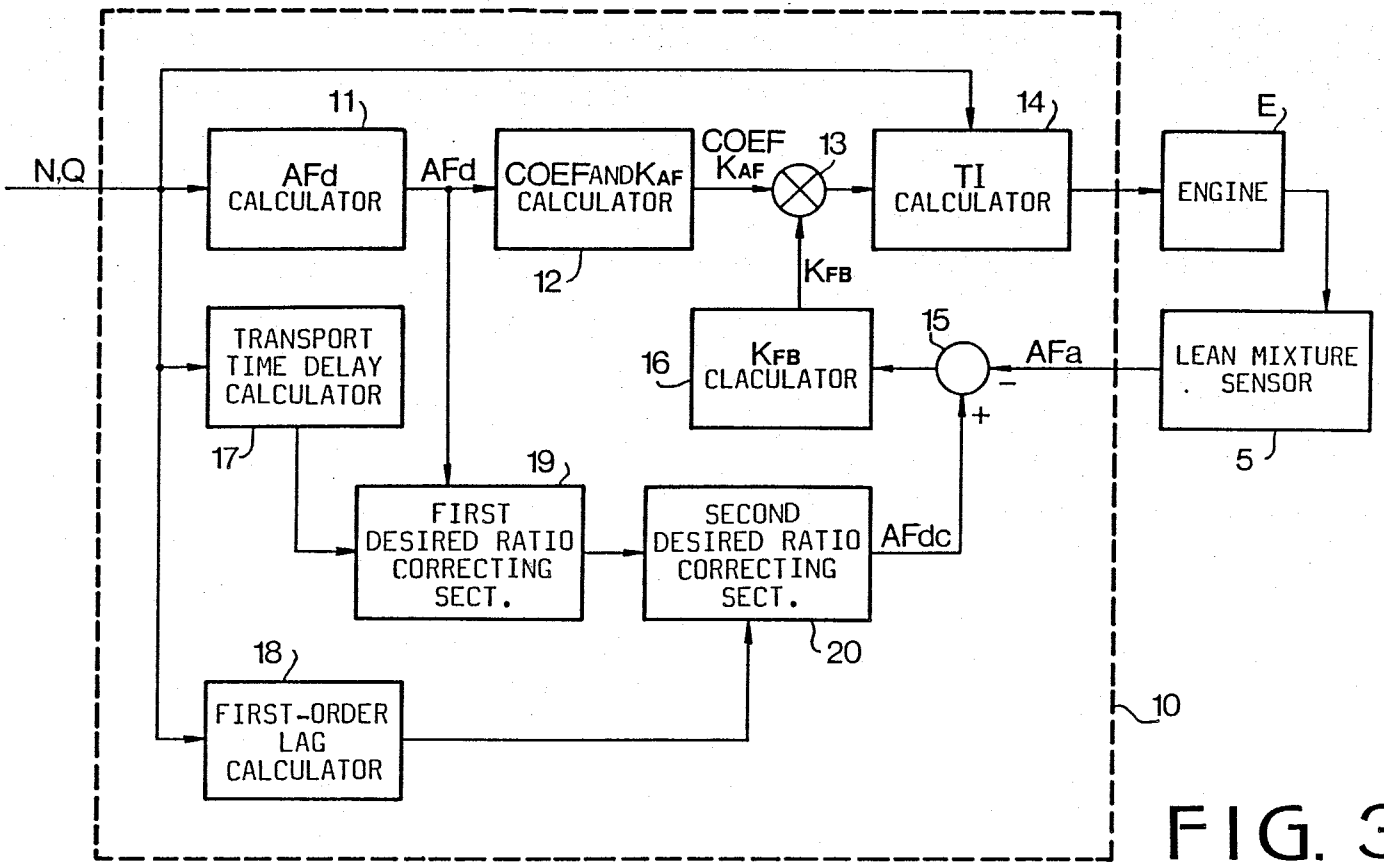
FIG. 3 is a block diagram showing the control system of the present invention.

FIG. 3 shows the control unit 10. The control unit 10 has a desired air-fuel ratio table 11 from which a desired air-fuel ratio AFd is derived in accordance with engine speed signal N and air flow signal Q. The signals N and Q are also applied to a transport time delay calculator 17 and a first-order lag calculator 18. The output of the transport time delay calculator 17 is fed to a first desired ratio correcting section 19, and the output of the first-order lag calculator 18 is fed to a second desired ratio correcting section 20. The calculator 17 calculates a transport time delay dependent on signals N and Q. The section 19 has a plurality of RAMs which store desired air-fuel ratios supplied from the table 11 at regular intervals. The section 19 operates to hold an old desired air-fuel ratio fed from the table 11 before the change of the desired ratio for the transport time delay T.

Figure 6:
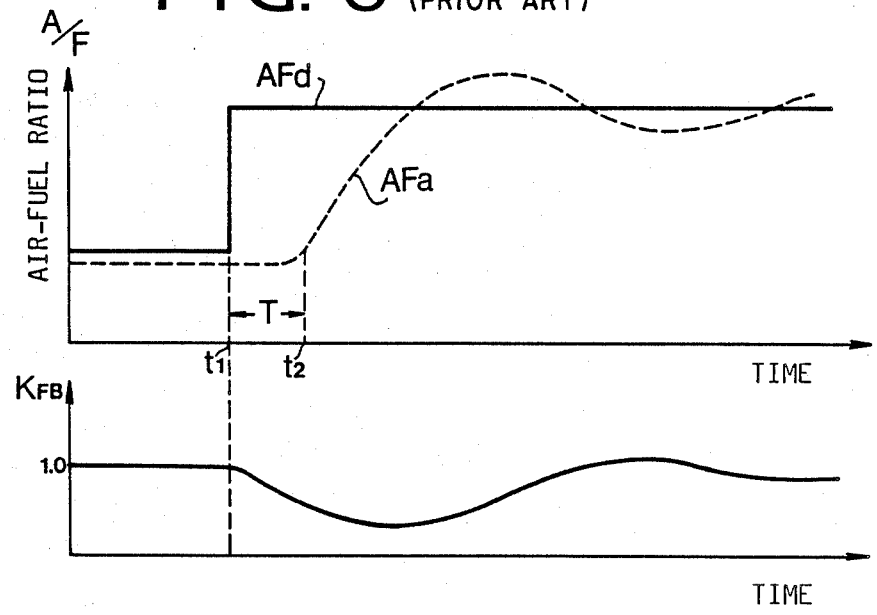
FIG. 6 (PRIOR ART)

As shown in FIG. 6, since the response delay curve AFa is approximate to a first-order lag, the response delay can be substituted with a first-order lag. Accordingly, calculator 18 makes the calculation of a first-order lag dependent on engine speed N and air flow Q. The section 20 operates to gradually change the output (corrected ratio) of the section 19 in accordance with the first-order lag from the calculator 18, by a proper method, for example by weight means. Thus, the desired ratio from the table 11 is corrected with transport time delay and response delay. The corrected ratio AFdc is applied to an adder 15.

On the other hand, the desired air-fuel ratio AFd is applied to an air-fuel ratio coefficient $K_{AF}$ and miscellaneous coefficient COEF calculator 12 which produces a coefficient $K_{AF}$ and a coefficient COEF. The adder 15 produces an error signal dependent on the difference between the corrected desired air-fuel ratio AFdc and the actual air fuel ratio AFa calculated from the feedback signal from the lean mixture sensor 5. The error signal is applied to a feedback coefficient calculator 16 which produces a feedback coefficient $K_{FB}$.

The coefficient $K_{AF}$, COEF and $K_{FB}$ are multiplied at a multiplier 13 and the product is applied to a fuel injection time calculator 14 where the above described calculation TI (equation 1) is made to produce a fuel injection signal. The fuel injection signal is applied to an engine E to inject fuel during the time TI.

Figure 4:
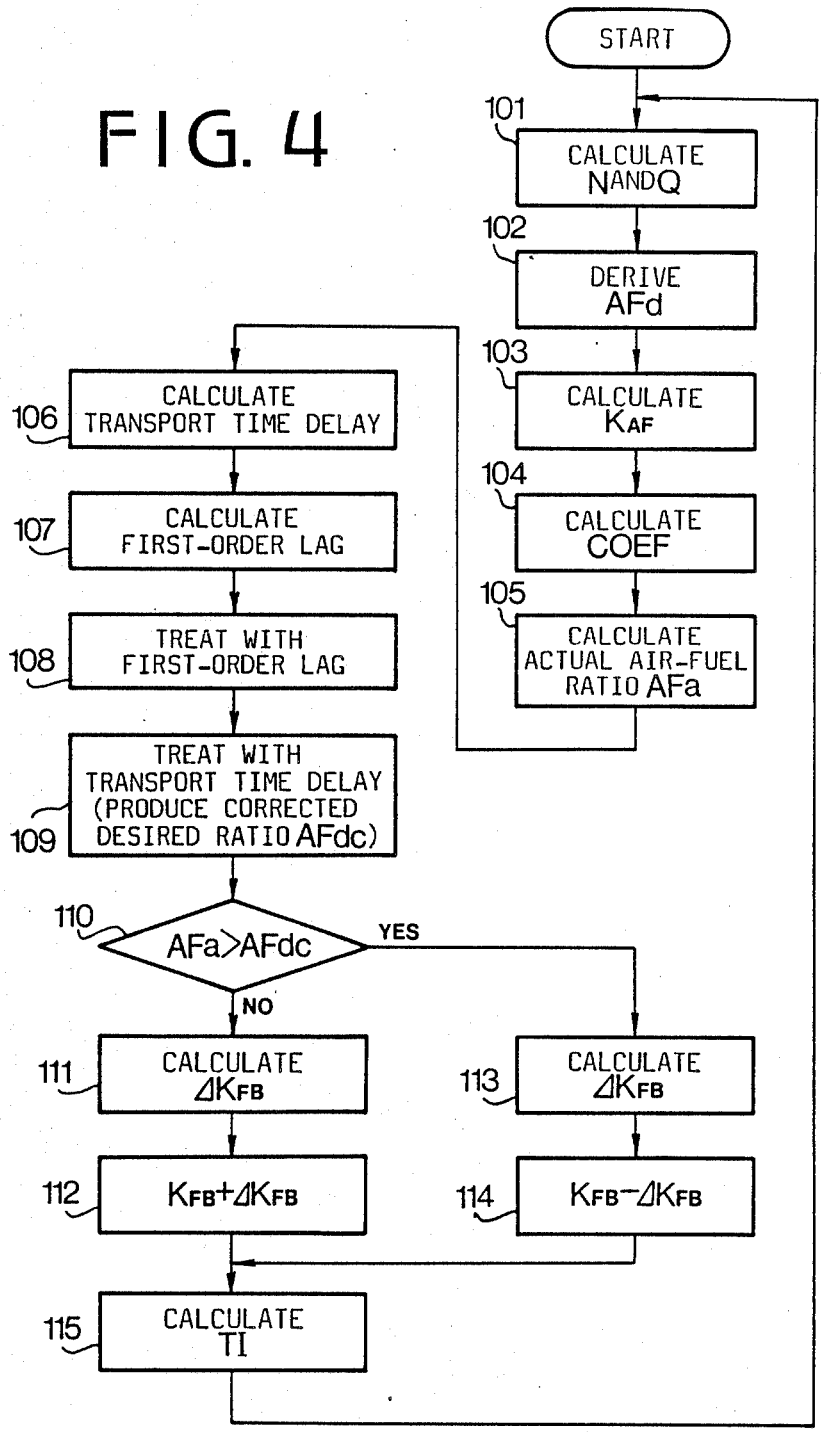
FIG. 4 is a flowchart showing the operation of the system.

FIG. 4 shows the operation of the system. From a step 101 to a step 110, the above described operations are performed. In accordance with the result of the comparison at the step 110, the feedback coefficient $K_{FB}$ is corrected at steps 111 to 114, and fuel injection time TI is calculated at a step 115.

Figure 5:
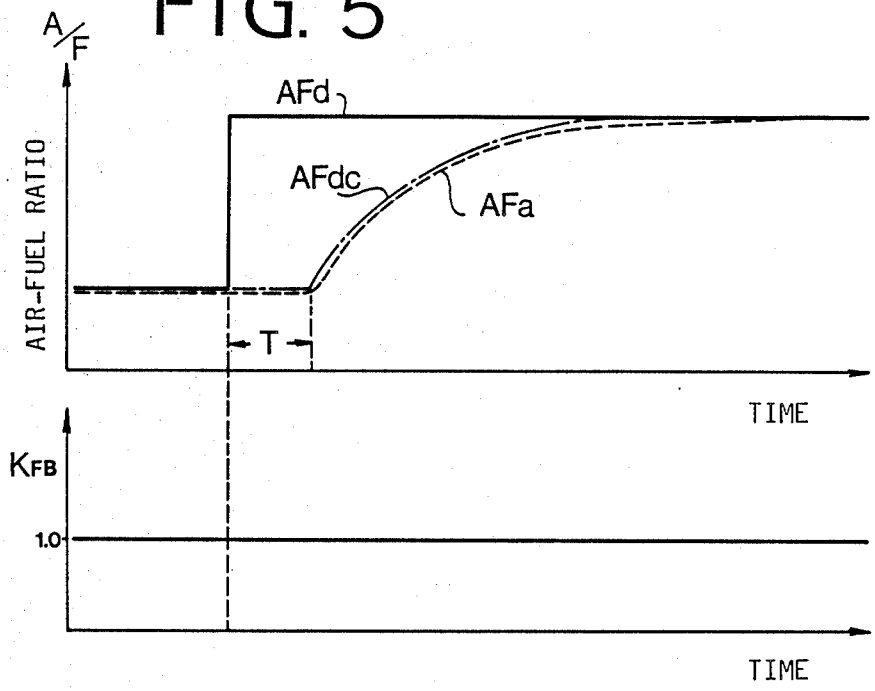
FIGS. 5 and 6 are graphs showing variations of air-fuel ratios in the system of the present invention and in a conventional system.

As shown in FIG. 5, the desired air-fuel ratio AFd is corrected to a corrected desired air-fuel ratio AFdc, which is a value before change of the desired ratio, for a transport time delay T, and gradually changes to the desired air-fuel ratio AFd in accordance with a response delay. Accordingly, the actual air-fuel ratio AFa is controlled to the desired ratio AFd without overshooting.

Figure 7:
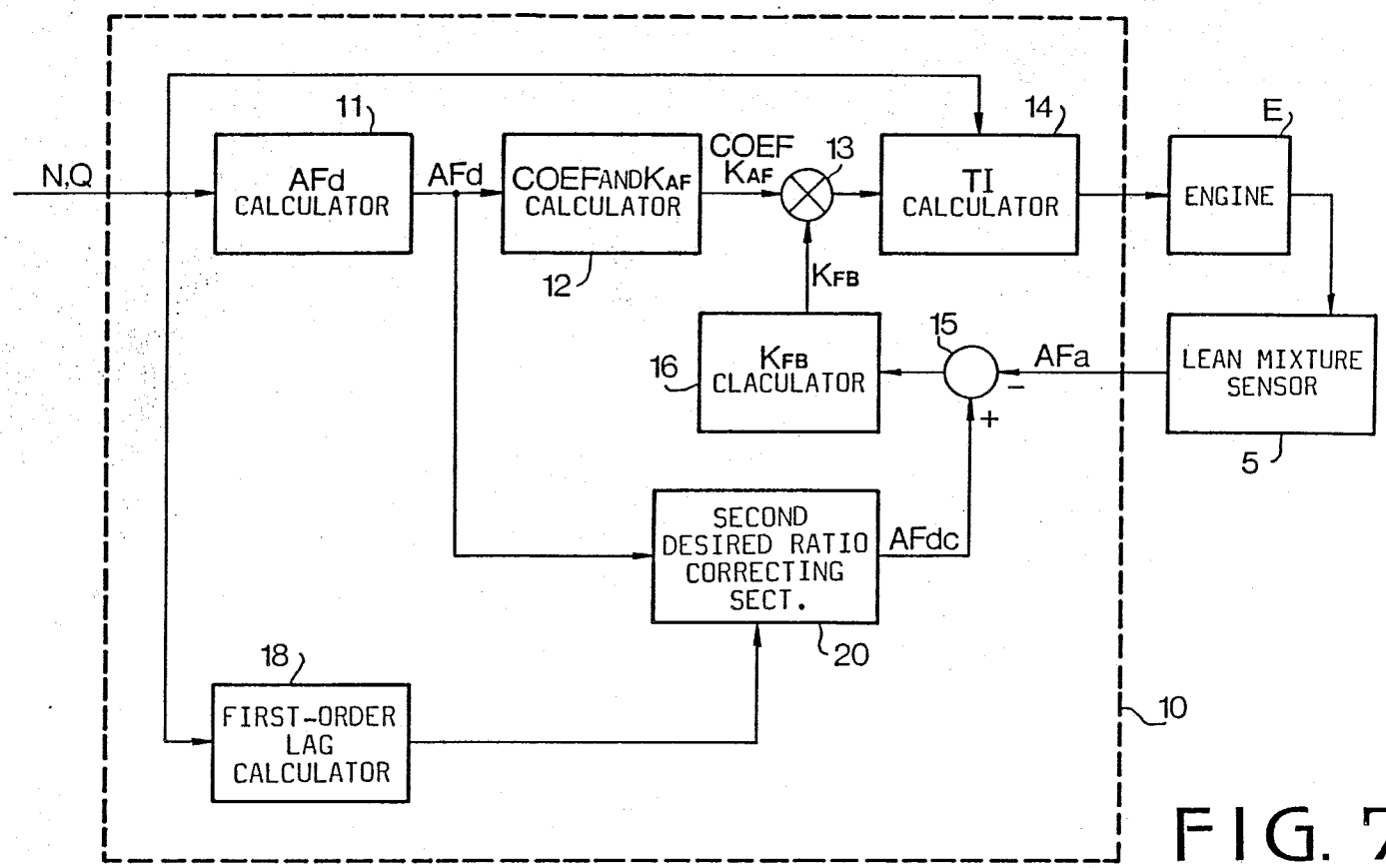
FIG. 7 is a block diagram showing another embodiment of the invention.
Figure 8:
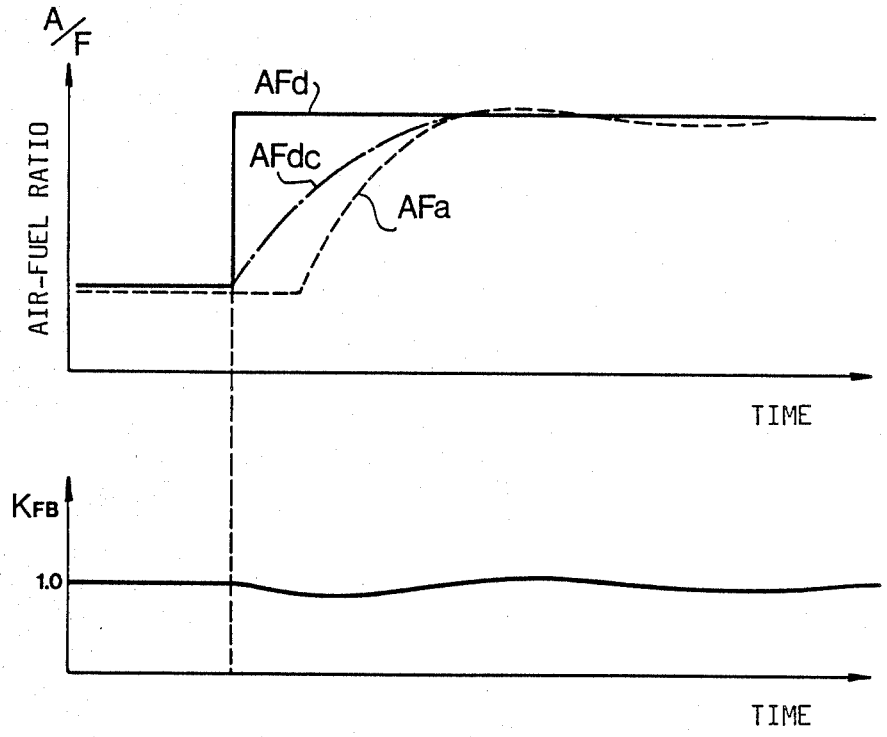
FIG. 8 is a graph showing variations of air-fuel ratios in the system of FIG. 7.

FIG. 7 shows another embodiment of the invention. In the drawing the same parts as FIG. 3 are identified by the same references as FIG. 3. In the system, the desired air-fuel ratio AFd is corrected only by a first-order lag. Accordingly, the corrected desired air-fuel ratio AFdc and the actual air-fuel ratio AFa change as shown in FIG. 8.

While the presently preferred embodiments of the present invention have been shown and described, it is to be understood that this disclosure is for the purpose of illustration and that various changes and modifications may be made without departing from the spirit and scope of the invention as set forth in the appended claims.

What is claimed is:

1. An air-fuel ration control system for an engine, comprising:

sensing means for sensing operating conditions and for producing operating condition signals;

a sensor for sensing oxygen concentration of exhaust gas of the engine and for producing a feedback signal dependent on the concentration;

first means responsive to the operating condition signals for producing a desired air-fuel ratio signal;

second means responsive to the operating condition signals for producing a time delay signal representing a time delay of control operation of the system;

third means responsive to the desired air-fuel ratio signal and the time delay signal for producing a corrected desired air-fuel ratio signal, the production of the corrected desired air-fuel ratio signal being delayed for a time dependent on the time delay and the corrected desired air-fuel ratio signal being changed from a small value to the desired air-fuel ratio in accordance with the time delay of control operation of the system;

fourth means for comparing the feedback signal with the corrected desired air-fuel ratio signal and for producing an error signal; and control means responsive to the error signal for determining amount of fuel to be supplied to the engine.

2. The system according to the claim 1 wherein the sensor is a lean mixture sensor for sensing oxygen concentration in burnt exhaust gas of lean mixture.

3. The system according to claim 1 wherein the control means includes means for calculating fuel injection time.

4. The system according to claim 1 wherein the time delay signal includes a first-order lag.

5. The system according to claim 4 wherein the time delay signal includes a transport time delay.

6. The system according to claim 4, wherein said third means changes the corrected desired air-fuel ratio signal to the desired air-fuel ratio in accordance with the first-order lag by weight means.

7. The system according to claim 2, wherein the lean mixture sensor has a voltage output proportional to the actual air-fuel ratio in the lean mixture leaner than stoichiometric (14.7).

8. The system according to claim 1, wherein said first means comprises a first-order lag calculator and a transport time delay calculator responsive to the operating condition signals, and first and second desired ratio correcting sections respectively connected to said transport time delay calculator and first-order lag calculator, said first desired ratio correcting section is responsive to said desired air-fuel ratio signal and is connected to said second desired ratio correcting section, and said second desired ratio correcting section produces said corrected desired air-fuel ratio signal.

9. The system according to claim 1, wherein said third means in response to said time delay signal changes the corrected desired air-fuel ratio signal from the small value to the desired air-fuel ratio without oscillating about the desired air-fuel ratio.

* * * * *